US006186355B1

(12) United States Patent
Luedecke

(10) Patent No.: US 6,186,355 B1
(45) **Date of Patent: *Feb. 13, 2001**

(54) COLLECTION DEVICE FOR SMOKING DEBRIS

(76) Inventor: Carol S. Luedecke, 709 Bayou Dr., Destin, FL (US) 32541

( * ) Notice: Under 35 U.S.C. 154(b), the term of this patent shall be extended for 0 days.

This patent is subject to a terminal disclaimer.

(21) Appl. No.: 09/101,511

(22) PCT Filed: Jan. 17, 1997

(86) PCT No.: PCT/US97/00833

§ 371 Date: Jul. 10, 1998

§ 102(e) Date: Jul. 10, 1998

(87) PCT Pub. No.: WO97/25887

PCT Pub. Date: Jul. 24, 1997

Related U.S. Application Data

(60) Provisional application No. 60/010,272, filed on Jan. 19, 1996.

(51) Int. Cl.[7] ..... A24F 19/00
(52) U.S. Cl. ..... 220/576; 220/676
(58) Field of Search ..... 220/576, 661, 220/676

(56) References Cited

U.S. PATENT DOCUMENTS

| | | | |
|---|---|---|---|
| 40,426 | 10/1863 | Hochstadter | D9/545 |
| D. 54,465 | 2/1920 | Schulte et al. | D27/107 |
| D. 82,128 | 9/1930 | Baylis | D27/133 |
| D. 248,329 | 6/1978 | Genaini | D27/123 |
| D. 306,259 | 2/1990 | Daucourt | D9/545 |
| D. 389,600 | 1/1998 | Luedecke | D27/118 |
| D. 397,496 | 8/1998 | Luedecke | D27/123 |
| 1,559,234 * | 10/1925 | Fleming | 220/576 |
| 1,645,525 * | 10/1927 | Fleming | 220/576 |
| 1,646,086 | 10/1927 | Fleming . | |
| 1,646,099 | 10/1927 | Mitchell . | |
| 1,662,171 | 3/1928 | Savery . | |
| 1,670,525 * | 5/1928 | Savery | 220/576 |
| 1,735,671 * | 11/1929 | Bunker | 220/576 |
| 1,807,079 * | 5/1931 | Wilmanns | 220/576 |
| 1,907,788 * | 5/1933 | Goertz et al. | 220/576 |
| 2,009,593 * | 7/1935 | Reichenbach | 220/576 |
| 2,114,027 * | 4/1938 | McDonald | 220/576 |
| 2,114,527 * | 4/1938 | Fox | 220/576 |
| 2,390,657 | 12/1945 | Loudermilk | 206/246 X |
| 2,567,166 | 9/1951 | Dick | 232/43.2 |
| 2,595,103 | 4/1952 | Schmaling, Sr. | 131/235.1 X |
| 4,142,537 | 3/1979 | Fenelon | 131/240 |

OTHER PUBLICATIONS

"Butt Can"—1205, Safety Cans Magazine, Manufacturing Company, May, 1994.
Form '87, p. 86, Group 2900 Library—Ashtray Publication Box.

* cited by examiner

*Primary Examiner*—Joseph M. Moy
(74) *Attorney, Agent, or Firm*—Womble Carlvle Sandridge & Rice

(57) ABSTRACT

A collection device (10') for the collection and disposal of cigarette butts (11), and other small combustible debris found in and around smoking areas. The collection device includes a body member (8") within which is defined a receptacle chamber (21') and a funnel-shaped throat passage (33) communicating with the receptacle chamber. The body member has an attached throat passage (33) extension that has side portals which communicate with the throat passage. As debris is received through the side portal, it is directed along the throat passage (33) and into the receptacle chamber (21') for collection.

24 Claims, 6 Drawing Sheets

COLLECTION DEVICE FOR SMOKING DEBRIS

CROSS-REFERENCE TO PROVISIONAL APPLICATION

This Application claims the benefit of priority from U.S. Provisional Application Ser. No. 60/010,272, filed Jan. 19, 1996.

FIELD OF THE INVENTION

The present invention relates in general to the disposal of combustible debris. In particular, the present invention relates to a collection device for the collection and disposal of cigarettes, cigars and other small combustible debris in and around smoking areas, which enables the debris to be easily collected and substantially completely extinguished to prevent the debris from smoldering and reduce risk of fire.

BACKGROUND OF THE INVENTION

In response to new laws on air quality and increasing health concerns over the dangers of inhaling secondhand smoke, many public and private buildings are now "smoke free", thus requiring all smoking materials to be extinguished prior to entering the building. To accommodate smokers, many buildings have designated "smoking areas", typically located outside the building, where smoking of cigarettes and cigars is freely permitted. Accordingly, most buildings generally have ash trays or other containers at the building entrances and designated smoking areas, in which smokers can dispose of their used smoking materials. Without such containers to hold discarded materials, the ground around the smoking area becomes littered with cigarette butts, matches, wrappers, and empty cigarette packs. The resulting debris is unsightly, and to the extent that it can pose a risk of fire, dangerous. However, the design and use of the ashtrays or garbage cans typically used by most buildings for disposing of smoker's debris has failed to adequately solve these problems and has led to additional problems.

For example, one of the most commonly used ash/trash designs comprises a trash can having a top with a shallow sand-filled depression. Cigarette butts are urged into the sand to stub out or smother them. Such ash/trash containers tend to become unsightly as the sand filled depressions become filled with cigarette butts and ash and invite the placement of other trash and debris therein. As a result, maintenance of these containers is difficult and undesirable. The sand must either be raked and the cigarette butts and other debris removed by hand, or dumped out and replaced, thereby wasting any clean sand that might remain. Additionally, the depression collects rainwater and other debris that mixes with the sand, hastening the degradation of the container and contributing to its smell and unsightly appearance. Consequently, more frequent cleaning/replacement of the sand is required.

The trash can below the sand filled depression also contributes to the problems of conventional ash/trash containers. As the top becomes filled, people tend to deposit smoking debris into the trash can, which typically is filled with combustible materials such as paper and plastic, causing a serious risk of fire. Additionally, people often leave debris destined for the trash can on top of the sand filled depression. The accumulated pile up of debris is unsightly and requires more clean up than trash neatly deposited inside the trash can.

Another conventional design for a smoking waste receptacle includes a device marketed under the brand name "Cease-Fire". This device comprises a steel waste container with a central circular opening in its top that directs smoke and gas back into the container so as to extinguish combustible material deposited therein. Unfortunately, people often try to insert other trash into the receptacle, clogging the opening and causing debris to pile on and around the receptacle. Also, the top opening enables ingress and collection of rainwater, making maintenance more difficult and frequent replacement necessary.

Another problem with most conventional ash/trash receptacle designs, as discussed above, is that they can easily spill collected debris when blown or knocked over by the wind, etc. Such spillage spreads the debris and requires quick cleanup.

Another cigarette receptacle design now being marketed under the name "Eagle® Butt Can" is designed solely for collection of cigarette butts. This design consists of a five gallon container with a narrow tube extending vertically from the container. The tube has an open end for depositing cigarette butts. The main problem with such a design is that the tube can easily become clogged when debris other than cigarette butts is inserted into its narrow throat. Also, because the opening is at the top of the tube, rainwater can still enter the container, making the can heavier and making cleanup messy and more difficult. The collection of rainwater in the base also causes the metal container to corrode and rust.

Therefore, it would be desirable to provide a receptacle or collection device for collecting cigar butts, cigarette butts, and other combustible debris that will resist becoming blocked as other debris is placed therein and which will extinguish smoking debris, without collecting rainwater and other debris, and which is easy to use and maintain.

SUMMARY OF THE INVENTION

Briefly described, the present invention comprises a low maintenance, decorative, indoor-outdoor receptacle or collection device for receiving and collecting smoking debris and other combustible material. The collection device of the present invention comprises a structural body which defines therewithin a first cavity, herein also referred to as the receptacle chamber, and an elongated, inner passage (also referred to herein as the "throat" or "throat passage") which passage tapers from a lower portal in communication with the receptacle chamber of the base to an upper portal open to the environment. Preferably, the throat passage is funnel-shaped. Preferably, the throat passage is positioned in the body structure directly over the receptacle chamber and the funnel-shaped passage narrows in a continual taper from the lower portal to the upper portal. Preferably, the characteristic dimensions of the throat passage are such that it promotes a "smothering effect" by remaining sufficiently long and narrow throughout its length and are also such that clogging of the throat passage is resisted. The smothering effect is an effect by which smoldering or smoking material within the receptacle chamber is extinguished. The smothering effect of the collection device is believed to be promoted by the fact that the elongated, narrow throat passage channels rising smoke into a continually narrowing space and the narrow upper portal is the only ingress and egress to/from the receptacle chamber. Thus, by promoting a Venturi effect, this configuration is believed to impede the ingress of oxygen to the receptacle chamber. The continually narrowing taper extending from the lower portal to the upper portal, among other effects, assists to prevent the inadvertent clogging by disposed foreign materials in the throat passage. In preferred embodiments, a shield member is provided positioned over and displaced from the upper portal. Preferably, access is provided to the receptacle chamber by which, through the use of one of numerous techniques and assemblies, collected material is removed from the receptacle chamber. Preferably, all entryways by which access is had to the receptacle chamber, except the throat passage, can be made substantially airtight to prevent excess oxygen from entering the receptacle chamber. By way of example, alternate embodiments include techniques/assemblies such as: an access port formed in the side of the body structure through which access is had to the receptacle chamber and a hinged door to selectively close off the access portal, the collected materials being removed with the aid of a small shovel, a rigidly formed liner or basket inserted like a drawer through the access portal into which the collected material falls, which drawer is inserted and removed through the access panel after opening the hinged door, the receptacle chamber with or without the rigid liner is defined in a separate base member of the structural body and a cover member through which the throat passage is defined is removable from the base member or is connected to the base member by a hinge such that, in either or any event, access to the receptacle chamber is had from above after moving or removing the cover member.

In accordance with a preferred, alternate embodiment of the present invention, the collection device of the present invention comprises a structural body which includes a separate base member, functioning as a receptacle element and defining the receptacle chamber therein, and a separate cover member defining therein the elongated, inner funnel-shaped throat passage, which cover member engages and fits over the base member such that, when assembled, access is had to the receptacle chamber only through the upper portal and, thus, through the throat passage. Preferably, a rigid liner is positioned within the receptacle chamber in alignment with the throat passage for receiving and containing the smoking debris and other materials placed into the upper portal. The cover member is attached to the base member by, for example, a slide lock mechanism, or by threading together interfacing male and female threads, or by other fastening techniques which will selectively and releasably hold the cover member and base member together such that, when desired, the cover member is removed to access the receptacle chamber, and liner, for clean-up.

In this preferred, alternate embodiment, the cover member is formed with a cap member adjacent the upper portal, which cap member includes a shield member positioned over and displaced from the upper portal and a throat passage extension with opposing side portals which provide side-oriented access to the upper portal.

The base and upper portion generally are comprised of a flame-retardant plastic or fiberglass material. Preferably, the body structure is of sufficient height to permit the convenient disposal by the smoker of spent smoking materials through the upper portal or, in alternate embodiments, through the side portals The liner is, acceptably, a bucket, preferably with a handle, which is formed of galvanized aluminum or steel. As smoking debris is received through the upper portal, it is directed through the passage and into the liner bucket for collection. The tapered design of the throat enables cigarettes and other debris to be received and directed into the receptacle cavity without clogging the throat while ensuring that the cigarettes, etc. will be smothered and thus extinguished within the collection device. In one exemplary, preferred embodiment, the cover member defines a conical-shaped outer wall which generally tracks or matches the shape of the inner throat passage.

Accordingly, it is an object of this invention to provide a decorative, easy to use and maintain collection device for collecting and receiving smoking debris and other combustible material.

Another object of this invention is to provide a collection device for collecting smoking debris and other combustible material having a portal sized and positioned at an elevation for easy access thereto for depositing smoking debris into the receptacle.

Still another object of this invention is to provide a collection device for receiving and collecting smoking debris and other combustible material, which device tends to extinguish combustible material collected therein so as to prevent smoldering and reduce air pollution and the risk of fire.

Still another object of this invention is to provide a collection device for collecting smoking debris that includes an aperture designed and adapted to receive smoking debris, but which discourages the disposal of other refuse therein.

A further object of this invention is to provide a collection device for collecting smoking debris that includes an upper portion having an inner, fluted passage such that if other refuse is placed therein, such refuse will tend to be directed to the base of the collection device so as to resist clogging or blockage of the inner passage of the collection device.

Various other objects, features and advantages of the present invention will become apparent to those skilled in the art upon reading the following specification, when taken in conjunction with the accompanying drawings.

DETAILED DESCRIPTION

Figure 1:
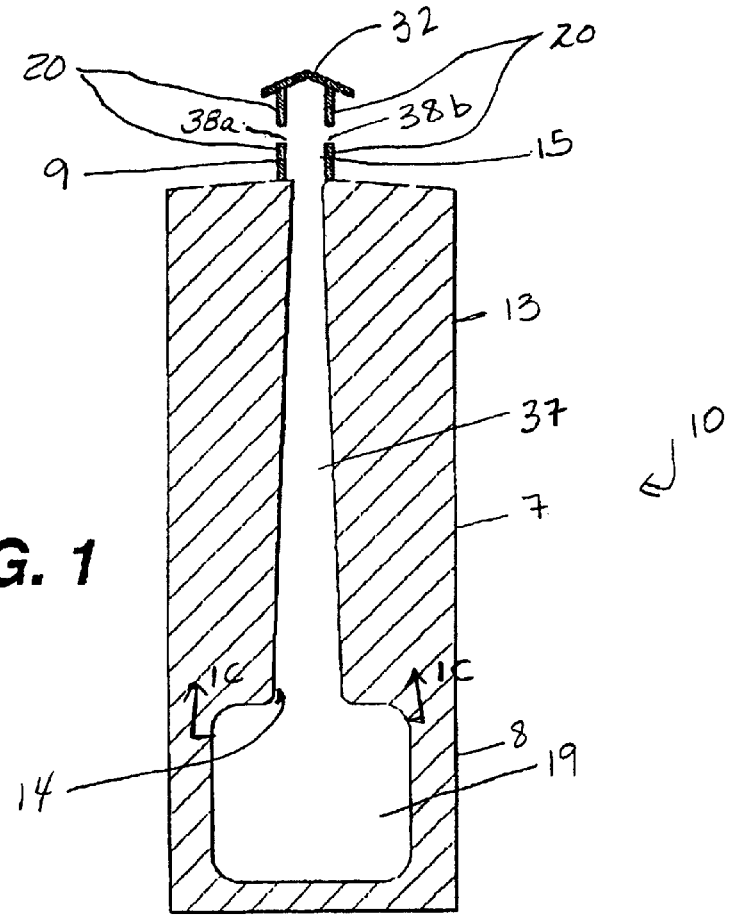
FIG. 1 is a cross-sectional side view of a collection device in accordance with the present invention.

Referring now in greater detail to the drawings in which like numerals refer to like components throughout the several views, FIG. 1 illustrates a collection device 10 for collection and disposal of combustible debris such as cigarette butts 11 (FIG. 4), cigar butts, matches, etc. The collection device 10 includes a body member 7. The lower portion 8 of the body member 7 defines a first cavity 19. The upper portion 13 of the body member 7 defines a throat or throat passage 37 which tapers from a lower portal 14 to a narrower, upper portal 15. Preferably, the throat passage 37 is located directly over the first cavity 19. The first cavity or receptacle chamber 19 communicates with the lower portal 14 of the throat passage 37. The lower portal 14 communicates through the tapering throat passage 37 with an upper portal 15. A throat passage extension 9 extends above the throat passage 37, defined by an extension wall 20 attached to the body member 7. Preferably, the throat passage extension 9 is positioned directly above the upper portal 15. Attached to the throat passage extension wall 20 and preferably positioned directly above the upper portal 15 is a shield member 32. Side portals 38*a* and 38*b* are located in the throat passage extension wall 20 and communicate through the extension passage 9 with the upper portal 15.

Figure 1B:
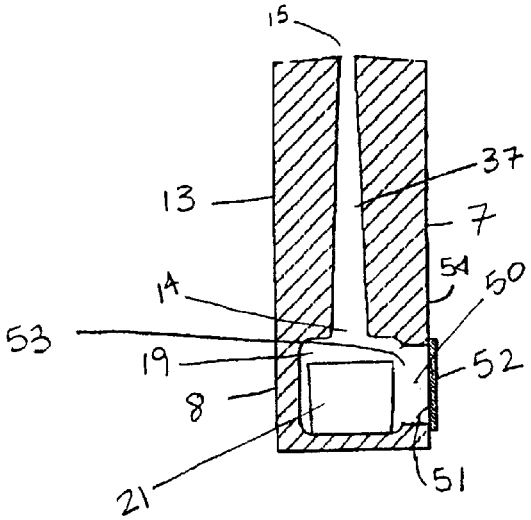
FIGS. 1A & 1B are isolated side views of portions of a collection device similar to that of FIG. 1, depicting alternate, example, debris removal techniques/assemblies associated with alternate embodiments of the device of FIG. 1.

The receptacle chamber 19 is of any shape which will create a relatively large volume cavity within the lower portion 8 of the body member 7, such as, for example, a bowl-shaped cavity. The throat passage 37 is of any shape which maintains the preferred taper from the lower portal 14 to the upper portal 15; however, preferably, the passage is formed as an elongated funnel-shaped passage having a circular cross-sectional end view. (See FIG. 1C.)

In accordance with this first embodiment of FIG. 1, the external shape and configuration of the body member 7 of the collection device 10 is not critical, so long as the body member is capable of defining therein the mentioned receptacle chamber 19 and throat passage 37. The body member 7 depicted in FIG. 1 is an example shape and configuration and represents a member of rectangular side cross-section, such as a rectangular parallelepiped or cylindrical member.

In use, the collection device 10 is designed to be positioned outside of a building or other area and, as smokers pass thereby, receives cigarettes, cigar butts and other small, combustible material through the side portals 38. The debris, etc. is received through the side portal 38 and is directed through the upper portal 15 and along the throat passage 37, through the lower portal 14 and into the receptacle chamber 19.

Figure 1A:
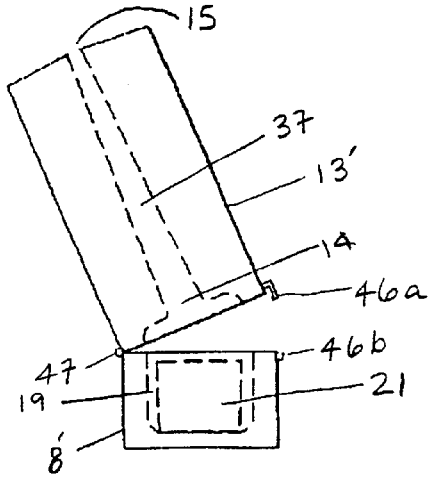
Figure 1C:
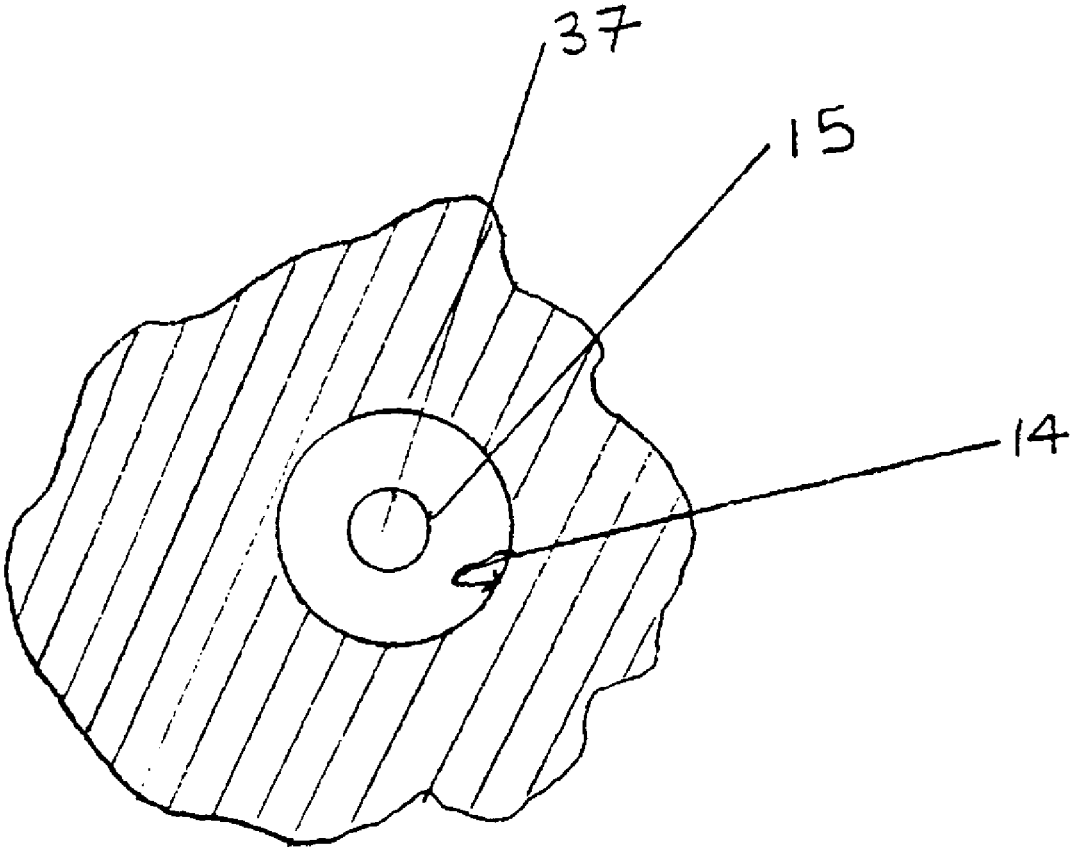
FIG. 1C is a sectional end view taken along line 1C—1C of FIG. 1, with the shield member and throat passage extension removed.

In an alternate embodiment, FIG. 1A, the collection device 10 consists of a cover member 13' and a base member 8'. The base member 8' rests on the ground and defines the receptacle chamber 19. Preferably, a rigid liner 21, sized to fit within the receptacle chamber 19 is placed therein. The base member 8' is connected to the cover member 13' by a hinge 47. A hasp lock 46*a* and 46*b* or other simple securing mechanism is located opposite the hinge 47. A throat passage 37 is defined inside the cover member 13'. Preferably, the throat passage 37 is positioned above the receptacle chamber 19. The lower portal 14 of the throat passage 37 communicates with the receptacle chamber 19 of the base member 8'. Preferably, when closed, the cover member 13' and base member 8' are substantially airtight to prevent excess oxygen from entering the receptacle chamber 19.

In this alternate embodiment, debris is removed from the receptacle chamber 19 by opening the hasp lock 46*a* and 46*b* and moving or removing the cover member 13' of the collection device 10 up and away from the base member 8'. This allows easy access to the receptacle chamber 19 and/or liner 21 therein for emptying.

In another alternate embodiment, FIG. 1B, the receptacle chamber 19 has a side opening 53. The receptacle chamber 19 communicates with an access port 50 through the side opening 53. A side door 52 is secured by a hinge 51 to the outside wall 54 of the collection device 10. Preferably, a liner 21, constructed of a rigid, fire retardant material and sized to fit inside the receptacle chamber 19 is located therein. Preferably the side door 52, is substantially airtight when closed so that oxygen cannot enter the receptacle chamber 19.

In this alternate embodiment, debris is removed from the receptacle chamber 19 by opening the side door 52 and using a shovel, vacuum, or other device to reach through the access port 50 and remove accumulated debris from the receptacle chamber 19. When the collection device 10 is in use, the side door 52 remains closed.

Figure 2:
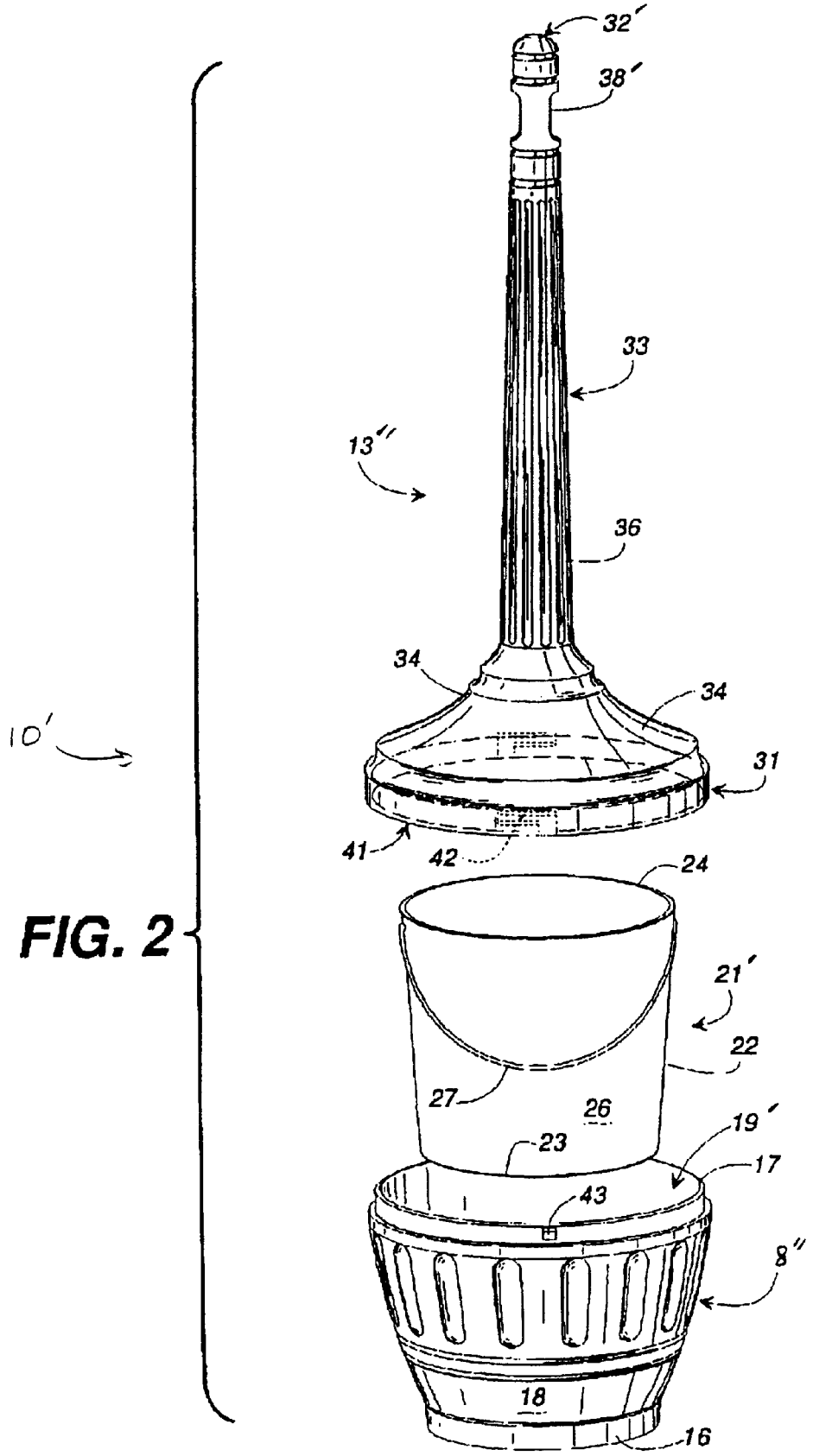
FIG. 2 is an exploded perspective view of a collection device in accordance with an exemplary, preferred embodiment of the present invention, showing the elements of the collection device.
Figure 3:
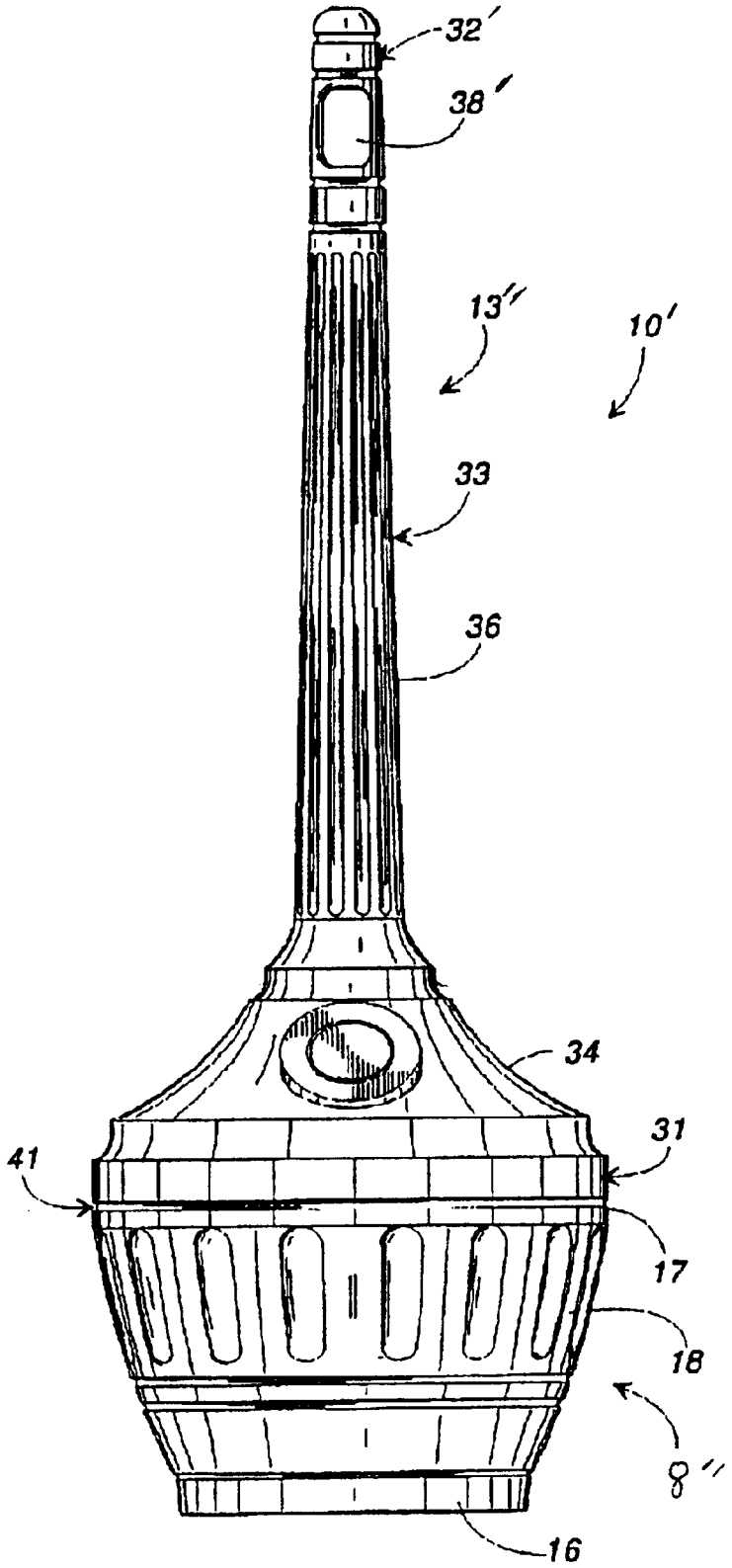
FIG. 3 is a side elevational view of the collection device for smoking debris of FIG. 2.
Figure 4:
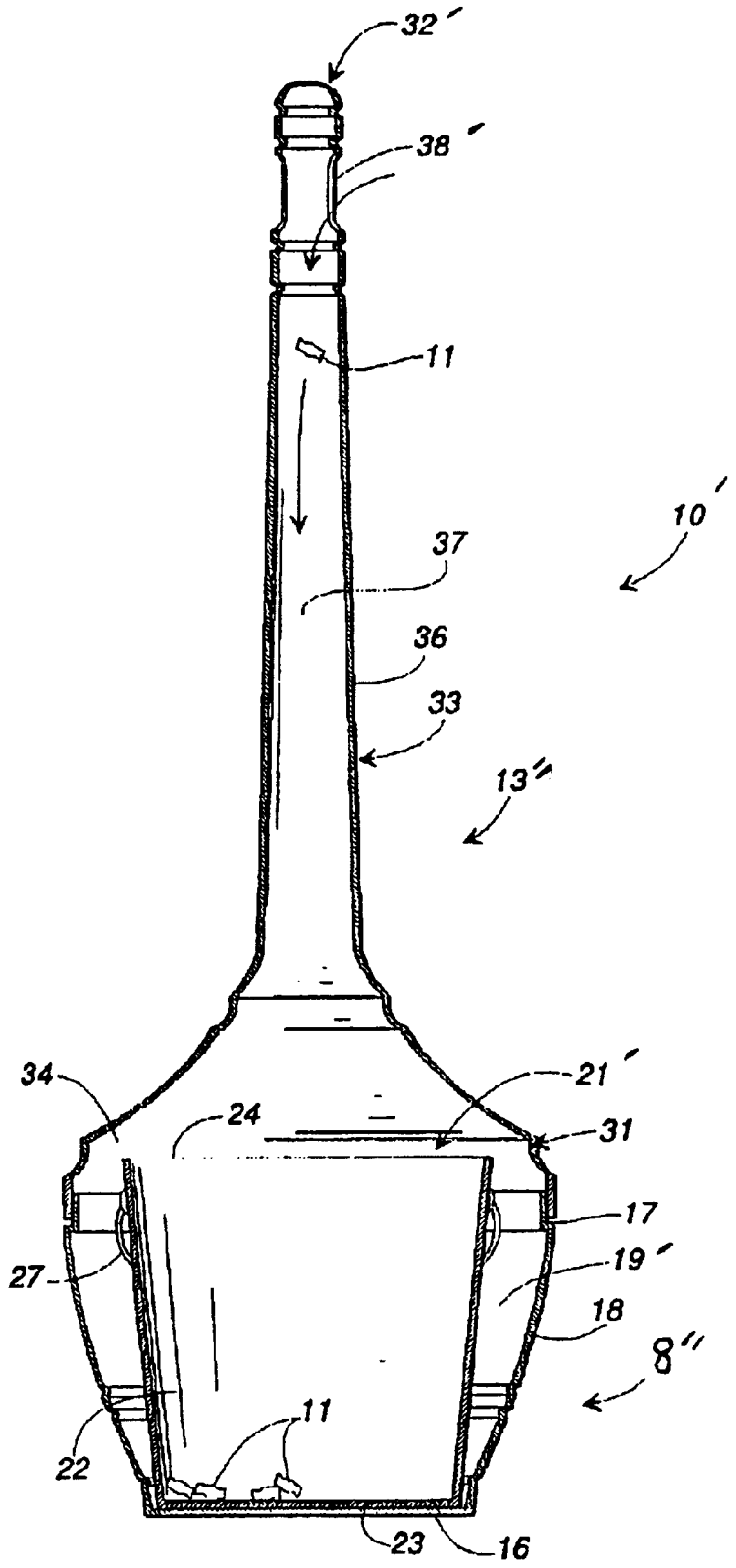
FIGS. 4 and 5 are a side elevational view of the collection device of FIG. 2, taken in cross-section, illustrating the collection of a cigarette or other smoking debris within the liner of the collection device.

FIGS. 2–4 illustrate an exemplary, preferred embodiment of collection device 10' for collection and disposal of combustible debris such as cigarette butts 11 (FIG. 3), cigar butts, matches, etc. As shown in FIGS. 2 and 3, the collection device 10' includes a base or lower portion 8" and an upper portion 13" that is secured to the base. The collection device typically is formed in an ornamental design so as to provide it with an aesthetically pleasing or decorative appearance for use of the collection device 10' in and around buildings and other public areas. Although the shape of the body member 7 is generally not defined as part of the invention, in this particular embodiment, the conical shape of the body member 7 is considered an inventive aspect. The base 8" and upper portion 13" generally are formed from a hard plastic or composite material, preferably a fiberglass acrylic material or a flame-retardant polyethylene, which enables the collection device to be formed or extruded in various ornamental designs, while being fire-retardant to reduce the hazard or risk of fire from smoldering cigarette butts and other combustible material.

As shown in FIGS. 2–4, the base 8" has a substantially cylindrical shape, and typically is a concave, bowl-shaped repository. The base 8" has a substantially flat lower end or bottom 16 adapted to rest on the ground, a substantially circular open upper end 17 and a cylindrical side wall 18. The side wall 18 and lower and upper ends 16 and 17 of the base 8" thus define an open ended receptacle or cavity 19' (FIGS. 2 and 4) of the base 8".

Preferably a liner 21' is received within the cavity 19' of the base 8" as illustrated in FIGS. 2 and 4. The liner is, preferably, a bucket or cylindrical can 22, typically a 10–14 quart size bucket, formed from plastic or metal material such as galvanized aluminum. The liner 21' includes a bottom 23 that rests on the bottom or lower end 16 of the base 8", an open upper end 24, and cylindrical side wall 26 The liner is positioned within the collection device 10' so as to receive and collect cigarette butts II (FIG. 4) and other combustible debris as it is deposited within the collection device. A handle 27 mounted to the side wall 26 of the liner typically is provided for easy removal of the liner from the base and carrying the liner for disposal of the collected cigarettes and other combustible material therein.

The upper portion 13" of the collection device 10' has a substantially fluted construction as illustrated in FIGS. 2–4. The upper portion includes a open first or lower end 31 that fits over and communicates with the open upper end 17 of the base 8", and a closed second or upper end 32 vertically spaced from the lower end. A tubular extension or throat portion 33 is formed between the first and second ends of the upper portion 13" and has a tapered construction that narrows towards the second or upper end 32' and flares outwardly, as indicated by 34, toward the first or lower end 31. As illustrated in FIG. 4, the throat 33 of the upper portion 13" is hollow, and includes a side wall 36 that defines a vertically extending internal passage 37 that extends from the second or upper end of the upper portion through the throat and communicates with the liner 21' in the base 8".

A side portal 38' is formed in the throat or tubular extension 33 adjacent the second end 32' of the upper portion 13", as illustrated in FIGS. 3 and 4. The side portal 38' typically is a substantially rectangularly-shaped opening, although the portal can be round or various other shapes as desired, and sized to receive cigarette and cigar butts, and other small, combustible debris therethrough. The side portal 38' communicates with the internal passage 37 (FIG. 4) of the upper portion 13" so that as cigarette butts 11 are received therethrough, they are directed downwardly and along the internal passage into the bucket 22 mounted within the base 8". The size of the aperture discourages input of large debris such as paper, cups, etc. into the collection device.

In addition, the fluted construction of the throat or tubular extension 33 of the upper portion 13" tends to restrict a flow of oxygen downwardly into the base 8" so that cigarettes, cigars and other combustible material do not have to be stubbed or snuffed out prior to dropping, them within the collection device 10' of the present invention. Instead, lit cigarette butts, etc. can be dropped within and the restriction of oxygen thereto by the design of the present invention causes the smoldering cigarette butts to be extinguished, thus substantially eliminating the risk of fire within the collection device.

As shown in FIG. 2, the upper portion 13" of the collection device 10' generally is attached to the base 8" by a side lock connector 42 and 43. With such a connector, a female slide lock 42 is formed along the lower edge of the upper connector portion 13" at its flared lower or first end 31. A male slide lock connector or lug 43 is formed on the upper end 17 of the base 8" and is adapted to engage and mate with the female slide lock connector 42 of the upper portion 13" so as to securely mount the upper portion to the base. This forms a substantially airtight seal between the base 8" and upper portion 13" so that the only inlet into the base is through the side portals 38' formed in the upper portion. In addition, as illustrated in FIG. 4, the upper portion 13" can be attached to the base 8" with a snap fitting, or threaded, or frictional engagement-type fitting to lock the upper portion and base together in a secure, substantially airtight arrangement.

Figure 5:
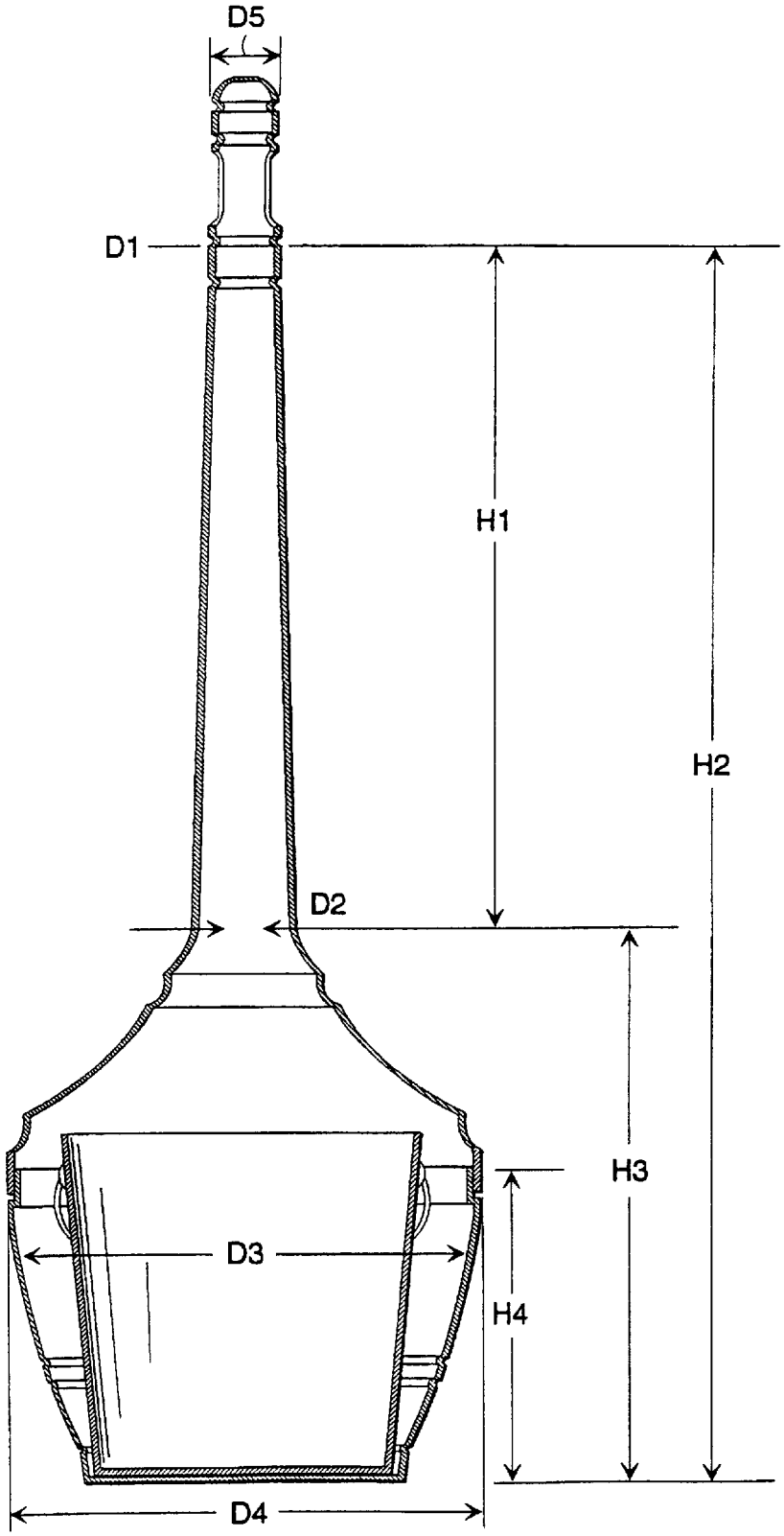

FIG. 5 depicts dimensional characteristics of a preferred embodiment of a collection device 10' of the embodiment disclosed by FIG. 2 hereof Preferred dimensional relationships are as follows: preferably, D2 should be at least two times D1 more preferably, D2 should be three times D1. Preferably, D3 should be 6 times D1 more preferably D3 should be 8 to 10 times D1. Preferably, H1 should be at least 10 times D1; more preferably, H1 should be 15 times D1.

One example of acceptable dimensions for a ground standing collection device made in accordance with the embodiment of FIG. 2 are as follows: the base is approximately 10–15 inches in height, approximately 12–16 inches in width and generally is formed having sufficient weight to ensure that the base will provide a stable platform that is not easily tipped or dislodged by wind or inadvertent contact with persons, etc. The upper funnel-shaped portion is approximately 28–34 inches in height. The throat of the upper portion tapers from approximately 4 inches in width to approximately 1 inch in width. The side portals, sized to receive small combustible debris, are approximately 1.5–3 inches tall. The entire collection device is approximately 38–49 inches tall. These dimensions are exemplary only and the invention is not to be limited thereby.

In use, the collection device 10' (FIG. 3) is designed to be positioned outside of a building or other area and, as smokers pass thereby, receives cigarettes, cigar butts and other small, combustible material through the side portals 38' formed in its upper portion 13" The cigarette butts 11, etc. are received through the portal 38' and are directed along the internal passage 37 (FIG. 4) into the bucket 22 of the liner 21' mounted within the base 8", where the cigarette butts and other combustible debris are collected. Should other material be urged through the portal 38' into the internal passage 37, the flared construction of the throat 33 of the upper portion tends to allow such material, once inserted through the portal, to pass along the internal passage without clogging the internal passage. As a result, the internal passage 37 is kept substantially free and clear for the receipt of cigarette butts and other combustible debris therethrough. When the collection device 10' needs to be emptied, the upper portion 13" is simply removed from the base 8" either by unscrewing the upper portion from its slide lock engagement, or by simply applying enough force to dislodge the upper portion from its frictional engagement. Thereafter, the bucket 22 is removed from the base 8", the collected debris dumped in a suitable waste receptacle, and the bucket replaced within the base. The upper portion 13" then is placed back on the base leaving the collection device ready for continued use.

Accordingly, it can be seen that the present invention provides an ornamental, aesthetically pleasing collection device for cigarette butts, cigar butts and other combustible debris that is easy to maintain and use and which smothers or causes smoldering debris to be extinguished so as to reduce or substantially eliminate the risk of fire and which, by its design, is simple to use and maintain and generally remains substantially free from clogging as additional debris is received therein. It further will be recognized by those skilled in the art that while the invention has been described above with reference to a particular embodiment, various modifications, changes and additions can be made thereto without departing from the spirit and scope of the invention as set forth in the following claims.

I claim:

1. A collection device for disposal of combustible debris comprising:

a base; and an upper portion mounted to said base;

wherein said upper portion includes an internal passage extending therethrough, said internal passage tapering from an open first end that communicates with said base to a closed second end vertically spaced from said base, said upper portion including a side wall and having at least one aperture formed in said side wall, said aperture communicating with said internal passage adjacent said closed end of said internal passage.

2. The collection device of claim 1, wherein said internal passage defines an elongated funnel-shaped passage tapering continuously from said first end to at least said aperture.

3. The collection device of claim 1, further comprising a liner received within said base.

4. The collection device of claim 3, wherein said base includes a closed lower end, an open upper end which engages and releasably mounts to said open end of said upper portion, and a side wall defining a cavity within which said liner is received.

5. The collection device of claim 3, wherein said liner comprises a bucket formed from a non-combustible material.

6. The collection device of claim 4 wherein said cavity of said base communicates with said internal passage of said upper portion.

7. The collection device of claim 3, wherein said shield member is positioned over opposing side apertures.

8. The collection device of claim 1, wherein said base has a first internal diameter, and wherein said internal passage has a second internal diameter adjacent said first end and a third internal diameter adjacent said second end, said first internal diameter being larger than said second internal diameter.

9. The collection device of claim 8, wherein the ratio of size of said second internal diameter to said third internal diameter is in a range of 2:1 to 3:1.

10. The collection device of claim 8, wherein the ratio of size of said second internal diameter to said third internal diameter is approximately 3:1.

11. The collection device of claim 8, wherein the ratio of the size of said first internal diameter to said third internal diameter is in a range of 6:1 to 10:1.

12. The collection device of claim 11, wherein the ratio of the size of said first internal diameter to said third internal diameter is approximately 10:1.

13. The collection device of claim 8, wherein:

said upper portion defines a height of said upper portion; and the ratio of the height of said upper portion to said third diameter is in a range of 10:1 to 15:1.

14. The collection device of claim 1, further including a plurality of apertures adjacent said second end.

15. The collection device of claim 1, wherein said internal passage tapers continuously from said first end to at least said one aperture.

16. The collection device of claim 1, wherein said upper portion is releasably mounted to said base.

17. The collection device of claim 1, wherein said base and said upper portion are inseparable and define a single body structure with a cavity within said base and said internal passage communicating with said cavity.

18. The collection device of claim 17, further comprising a portal in said base for accessing said cavity, and a liner removably received within said cavity of said base, said liner being received in said cavity through said portal.

19. The collection device of claim 1, wherein said closed second end is defined by a shield member positioned over said internal passage, and wherein said at least one aperture is defined in said side wall below said shield member.

20. The collection device of claim 8, wherein said second internal diameter is at least two times said third internal diameter.

21. The collection device of claim 8, wherein said first internal diameter is at least six times said third internal diameter.

22. The collection device of claim 8, wherein:

said upper portion defines a height of said upper portion; and the height of said upper portion is at least ten times said third diameter.

23. The collection device of claim 16, further comprising a means for selectively attaching said upper portion to said base.

24. The collection device of claim 23, wherein said attachment means comprises a threaded connector with a first thread formed about a lower end of said upper portion and a second thread formed upon said base whereby threading engagement secures said upper portion to said base.

* * * * *